US007203997B2

(12) United States Patent
Morgan

(10) Patent No.: US 7,203,997 B2
(45) Date of Patent: Apr. 17, 2007

(54) HINGE

(75) Inventor: James C. Morgan, Little Rock, AR (US)

(73) Assignee: William D. Morgan, Little Rock, AR (US)

( * ) Notice: Subject to any disclaimer, the term of this patent is extended or adjusted under 35 U.S.C. 154(b) by 88 days.

(21) Appl. No.: 10/949,203

(22) Filed: Sep. 27, 2004

(65) Prior Publication Data

US 2006/0070212 A1 Apr. 6, 2006

(51) Int. Cl.
*E05D 11/06* (2006.01)
*E05D 15/00* (2006.01)

(52) U.S. Cl. ..... 16/358; 16/369; 108/67

(58) Field of Classification Search ..... 16/358, 16/365, 366, 368, 369; 108/67, 68, 117, 108/115, 128; 312/258, 262, 326
See application file for complete search history.

(56) References Cited

U.S. PATENT DOCUMENTS

| | | | | | |
|---|---|---|---|---|---|
| 61,766 | A | * | 2/1867 | Schafer | 16/358 |
| 277,925 | A | | 5/1883 | Pfauntz | |
| 429,391 | A | * | 6/1890 | Slane | 16/366 |
| 1,075,130 | A | * | 10/1913 | Streberger | 16/358 |
| 1,265,363 | A | | 5/1918 | Nixon | |
| 1,484,093 | A | * | 2/1924 | Soss | 16/358 |
| 1,619,502 | A | * | 3/1927 | Fox | 16/358 |
| 1,688,996 | A | * | 10/1928 | Soss | 16/358 |
| 1,735,696 | A | | 11/1929 | Ridley | |
| 2,008,257 | A | * | 7/1935 | Lefevre | 16/360 |
| 2,227,871 | A | * | 1/1941 | Wigell | 403/65 |
| 2,236,400 | A | | 3/1941 | Follmer | |
| 2,320,772 | A | * | 6/1943 | Doman | 16/358 |
| 2,608,713 | A | | 9/1952 | Soss | |
| 2,867,839 | A | * | 1/1959 | Squire | 16/358 |
| 2,872,697 | A | | 2/1959 | Hizsa, Jr. | |
| 3,359,593 | A | * | 12/1967 | Lautenschlager, Jr. | 16/358 |
| 3,881,221 | A | * | 5/1975 | Schmidt | 16/366 |
| 4,242,773 | A | | 1/1981 | Beigh | 16/164 |

(Continued)

FOREIGN PATENT DOCUMENTS

| | | |
|---|---|---|
| DE | 188 989 | 4/1964 |

(Continued)

OTHER PUBLICATIONS

DeCrane Aircraft Seating Company: "Precision Hinges & Mounting Blocks", website: http://dasc-inc.com/precision.asp, two pages, accessed Sep. 22, 2004.

*Primary Examiner*—Chuck Y. Mah
(74) *Attorney, Agent, or Firm*—Fitzpatrick, Cella, Harper & Scinto

(57) ABSTRACT

A hinge includes a link with two lateral sides, and an assembly comprising a pair of side plates. Protruding from each lateral side of the link is a pair of parallel pins, and each side plate includes a pair of non-parallel guide slots. The assembly and the link are positioned such that each pin slidably engages one of the guide slots and the pins can simultaneously slide in their respective guide slots. Since the guide slots are non-parallel, when one pin is forced to slide in one direction, the other pin of the pair is forced to slide in a different direction, causing the assembly to both turn and translate with respect to the link.

27 Claims, 7 Drawing Sheets

U.S. PATENT DOCUMENTS

| | | | | | |
|---|---|---|---|---|---|
| 4,322,870 | A | * | 4/1982 | Lautenschlager | 16/235 |
| 4,915,034 | A | * | 4/1990 | Grabe et al. | 108/65 |
| 4,928,350 | A | | 5/1990 | Morgan | 16/297 |
| 5,282,293 | A | | 2/1994 | Pedoeem | 16/342 |
| 5,493,760 | A | | 2/1996 | Takimoto | 16/366 |
| 5,659,929 | A | | 8/1997 | Cheng | 16/366 |
| 5,685,046 | A | | 11/1997 | Neag et al. | 16/366 |
| 5,901,415 | A | | 5/1999 | Morrison et al. | 16/371 |
| 5,915,441 | A | | 6/1999 | Schlack | 16/371 |
| 5,943,739 | A | | 8/1999 | Vandergriff | 16/366 |
| 6,493,906 | B2 | * | 12/2002 | Matteau | 16/358 |
| 6,564,428 | B2 | | 5/2003 | Richard et al. | 16/366 |
| 6,629,337 | B2 | | 10/2003 | Nania | 16/334 |
| 2004/0045131 | A1 | | 3/2004 | Barnett | 16/367 |

FOREIGN PATENT DOCUMENTS

| | | | | |
|---|---|---|---|---|
| DE | 3023637 | A1 | | 1/1981 |
| DE | 3505047 | A1 | * | 6/1986 |
| FR | 2845112 | A1 | * | 4/2004 |
| GB | 2 033 956 | A | | 5/1980 |
| JP | 7-109863 | | | 4/1995 |
| JP | 7-279525 | | | 10/1995 |
| JP | 2002-121955 | | | 4/2002 |
| JP | 2003289948 | A | * | 10/2003 |
| JP | 2004065465 | A | * | 3/2004 |

* cited by examiner

HINGE

FIELD OF THE INVENTION

The present invention relates to a type of hinge that can be used for, among other things, attaching a table leaf to a table top in a drop-leaf table in which the leaf, when not extended, is folded onto the top of the table (a "fold-over/drop-leaf table").

BACKGROUND OF THE INVENTION

As described in my prior patent, U.S. Pat. No. 4,928,350, in certain hinge applications it is desirable for the hinge to allow the two objects it joins to be so close together when the hinge is at a certain position in its swing path that there is little or no gap between the objects. An example is a drop-leaf table. When the leaf and the table top are in the coplanar position—i.e., the leaf is extended—it is preferred that there be little or no gap between them.

Often in such drop-leaf table applications it is also preferred that no part of either hinge extend above the top and leaf when in the coplanar position—i.e., that the extended table top be smooth and uninterrupted, particularly uninterrupted by hinge pins that protrude above the surface. This requires that the hinge-pin axes be at an elevation below the upper surface of the table top. Normally that is not a problem if the leaf folds down. But if the leaf is to fold onto the top of the table, it is difficult to accomplish both objectives: positioning the hinge pins below the upper surface and having little or no gap between the top and the leaf when in the coplanar position. When using a conventional hinge, the greater the distance between the sunken hinge-pin axes and the upper surface of the table top, the wider must be the clearance gap between the top and the leaf.

SUMMARY OF THE INVENTION

The hinge of the present invention addresses this problem by using a mechanism that causes the joined objects, when being swung away from the close-together position, to also move slightly apart from one another as they pivot. By moving the opposed faces of the two hinged-together objects apart as the objects swing away from the close-together position, there is less need of a clearance gap when in the close-together position. To accomplish this simultaneous translation and pivoting movement, the hinge of the present invention comprises:

(a) a link having a first end, a second end, and two lateral sides;

(b) a first assembly comprising a pair of first side plates, one first side plate positioned on each lateral side of the link near the first end of the link; and (c) two hinge interfaces, each hinge interface comprising:

(i) one of the lateral sides of the link; and (ii) the side plate positioned adjacent to that lateral side of the link; and (iii) a pair of parallel pins, each pin protruding from either the lateral side of the link or the side plate, such that each pin in the hinge interface is axially aligned with one pin in the other hinge interface; and (iv) a pair of non-parallel guide slots, each guide slot being disposed in either the lateral side of the link or the side plate.

Each pin slidably engages one of the guide slots and the pair of pins can simultaneously slide in their respective guide slots. Since the guide slots of each pair of slots are non-parallel, when one pin is forced to slide in one direction, the first assembly is forced to both turn and translate with respect to the link. Thus, if the hinge is at its close-together position and a turning force is applied to the first assembly, the first assembly will not only swing out of that plane, it will also shift to the side, putting more distance between the two objects that are hingedly joined together.

The two pins of each interface can either protrude from the same element (the link or the side plate) or protrude from different elements—i.e., one pin can protrude from the lateral side of the link while the other protrudes from the side plate. The same is true of the two guide slots of each interface: Either they can both be disposed in the same element (the link or the side plate) or one can be disposed in the lateral side of the link and the other in the side plate. For ease of distinction, the arrangement wherein the two pins protrude from the same element will arbitrarily be called the "paired arrangement," and the arrangement wherein the pins protrude from different elements will arbitrarily be called the "unpaired arrangement."

For ease of manufacture and assembly, preferably the paired arrangement will be used. That is, the two pins of each interface will protrude from one element and the two guide slots will be disposed in the other element. In other words, the hinge comprises:

(a) a link having a first end, a second end, and two lateral sides, and, near the first end of each lateral side of the link, either:

(i) a pair of parallel pins protruding from each of the opposite sides, the pins being spaced apart from each other by a fixed distance, and the pins protruding from one side being axially aligned with the pins protruding from the other side, or (ii) a pair of non-parallel guide slots; and (b) a first assembly comprising a pair of first side plates, one first side plate positioned on each lateral side of the link near the first end of the link, and each first side plate having the other of (i) and (ii), such that each pin slidably engages one of the guide slots and the pair of pins can simultaneously slide in their respective guide slots, while remaining the fixed-distance apart from each other.

In the paired arrangement, since the guide slots of each pair of guide slots are non-parallel, when one pin is forced to slide in one direction, the other pin of the pair is forced to slide in a different direction, thereby causing the first assembly to both turn and translate with respect to the link. By contrast, in the unpaired arrangement, moving one pin in one direction does not cause the second pin to move; rather, the second pin stays still because it is not disposed on the same element as the first pin. However, in both the paired and unpaired arrangements, the relative movements of the pins and slots causes the first assembly to both turn and translate with respect to the link. Consequently, in both arrangements, the link and first assembly are pivotable between a position at which they are relatively close together and a position in which they are further apart.

Although the two guide slots in each pair are angled toward each other, preferably the slots themselves do not intersect. In this way, there can be smooth, uninterrupted boundary walls for the pins to slide against. It is also preferred that at least those portions of the slots that guide the pins through the first 90 degrees of swing from the close-together position be substantially straight.

The first assembly can be connected to one object, while the second end of the link is connected to a second object. Both connections can be either direct or indirect (via one or more additional elements).

The connection between the second end of the link and the second object can be pivotal or nonpivotal. By a nonpivotal connection, it is meant that the second end of the link is integrally formed with, fixed to, or slidably attached to the second object, but the link is not be pivotable relative to the second object. If the connection is a pivotal connection, it can be beneficial to use the same type of pins-and-grooves arrangement as used at the first end of the link. In that way, two objects that are coplanar when in the close-together position (e.g., the table top and leaf of a fold-over/drop-leaf table when in the leaf-extended position) can be folded back through approximately 180 degrees of arc with less chance of interference. Thus, in the fold-over/drop-leaf table example, if the first assembly is mounted to the leaf and the second assembly is mounted to the top, when the extended leaf is swung up to vertical by pivoting the first assembly 90° with respect to the link, the face of the leaf that is opposite the top when in the extended position (the "opposed edge-face") not only turns to face downward (toward six o'clock), it simultaneously moves to the side. Then the upstanding leaf can be folded down, onto the top, by forcing the link to pivot 90° with respect to the second assembly. While traversing this second 90° turn, the leaf's opposed edge-face raises up as it turns, and ends up facing the same direction as is faced by the top's opposed edge-face. By achieving this second (vertical) separation, the hinge can be mounted even a greater distance below the top surface.

In this last-mentioned embodiment, it is preferred that a restrainer be disposed in at least one of the four guide slots associated with the second end of the link, so that the pin in that guide slot is restrained from sliding in the guide slot until at least a predetermined threshold force is applied to the pin. In this manner, since the second assembly is restrained, the first assembly swings fully between the extended and folded positions before the second assembly begins to swing relative to the link, thereby causing the first and second assemblies to swing sequentially. It is contemplated that any type of pin restrainer can be used. Specific examples include an elongated piece of elastomeric material that extends at least part of the length of the guide slot, as well as a leaf spring having two ends and a convex central portion, the two ends of the spring being positioned against a side of the guide slot, with the convex central portion protruding into the center of the guide slot. I contemplate that other types of restrainers, such as compression springs, torsion springs, cantilever springs, interference fits between parts, and the like, could also be advantageously used to practice my invention. In each of the foregoing examples, the restrainer element(s) should preferably be positioned in or adjacent to one or more of the guide slots. Most preferably, restrainers will be disposed in guide slots associated with both sides of the second end of the link, not just one.

To add strength to the hinge, it is preferred that there be a first projection extending from one end of the link and that the first assembly comprise a first end plate having a stop slot that cooperates with that projection. There is preferably also a tab that protrudes from each member of the pair of second side plates, in combination with slots in each lateral side of the link. With the first assembly being pivotable relative to the link between an extended position and a folded position, these elements are so arranged that further pivoting of the first assembly relative to the link beyond the extended position is limited by abutment of the first projection of the link against the stop slot of the first end plate (at a first "stop point") and/or by abutment of the notch in each lateral side of the link against the tab of each of the first side plates (at a second stop point). In this arrangement, the stress on the hinge is concentrated at the stop points, rather than the pins, when the leaf is in the extended position. This provides the hinges with a greater mechanical advantage and distributes the resulting stresses over a larger area than the pins. Accordingly, the hinge is able to support greater loads. For example, when a hinge according to my invention is used in a fold-over/drop-leaf table, each hinge is able to support loads in excess of 100 pounds applied to the leaf at a distance of ten inches from the hinge center of the hinge. Such high loads may be present when, for example, a person presses down on the leaf while either rising from the table or stretching across it in order to inspect something resting on the other side.

If the hinge includes one of the aforementioned assemblies attached to each end of the link, it is preferred that this arrangement of projection, tabs, and slots be provided at both ends of the link.

It is also preferred that each assembly in the hinge further comprise a mounting member, to which the side plates and end plate are attached. The mounting member should be configured to be attached to one of the objects that are to be hingedly connected, such as the aforementioned table top and leaf combination, a door and door frame combination, or the like.

The invention will be better understood by studying the drawings accompanying this specification, which depict a preferred embodiment of the hinge.

DESCRIPTION OF THE PREFERRED EMBODIMENT(S)

Figure 3:
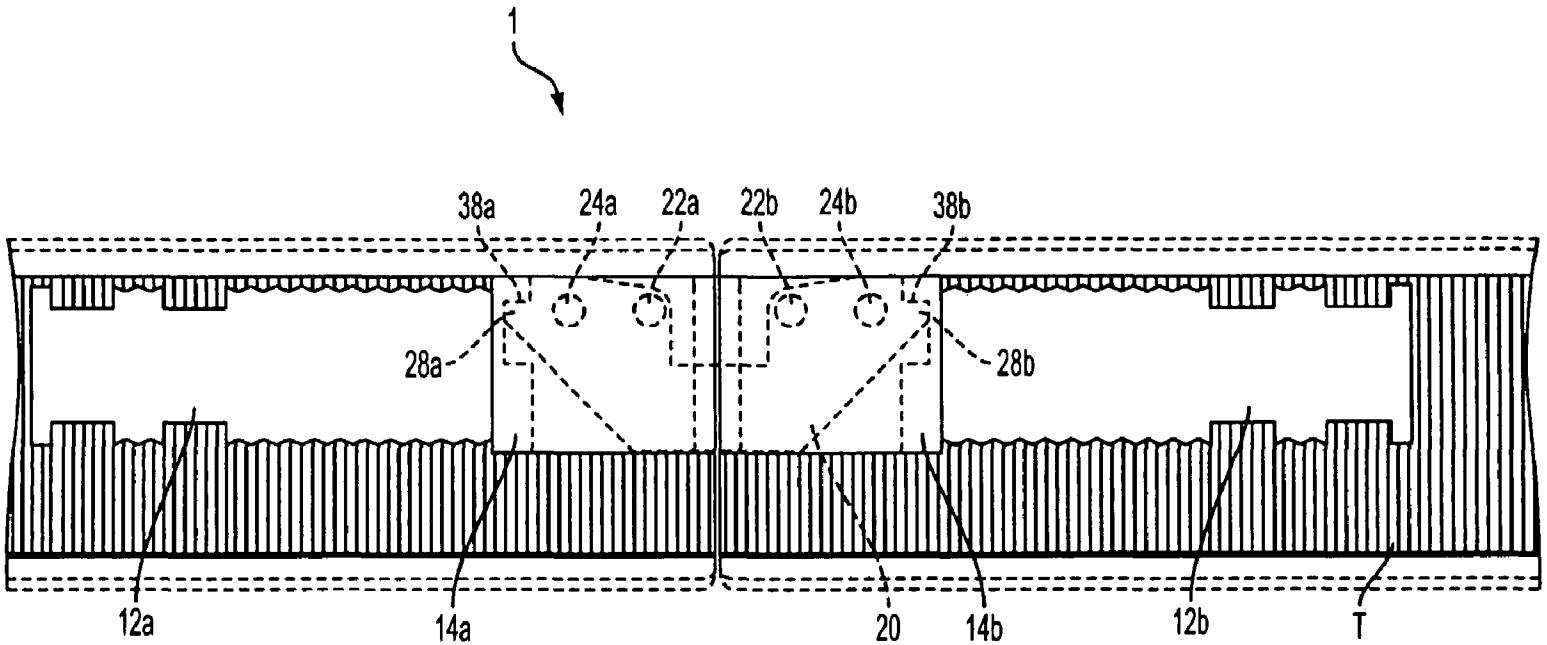
FIG. 3 is a cross-sectional view of the assembled hinge depicted in FIG. 1, taken along line 3—3 in FIG. 1, and also showing, in dense vertical cross-hatch lines, portions of a tabletop and leaf to which the hinge is mounted.
Figure 4:
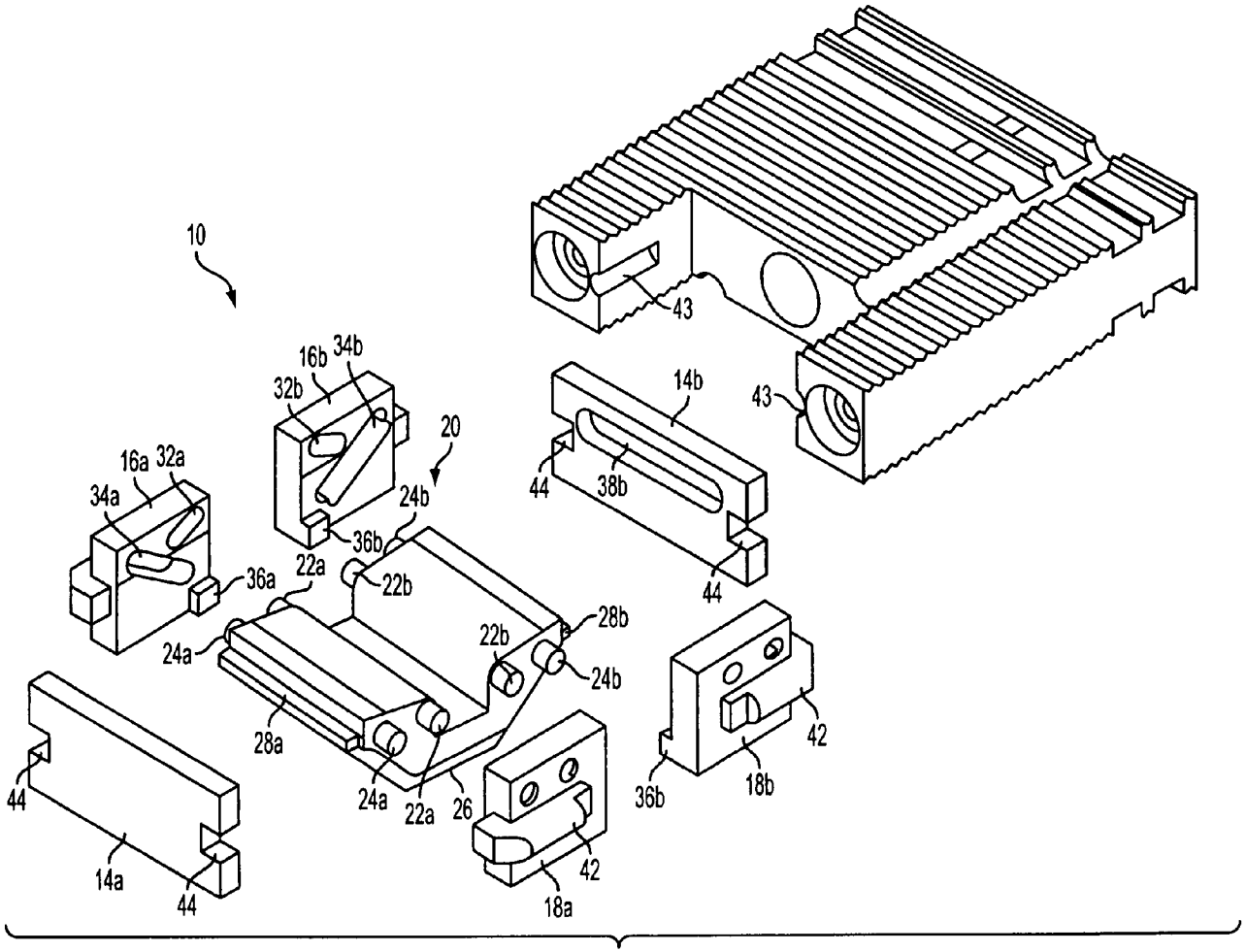
FIG. 4 is an isometric view of the disassembled hinge.
Figure 5A:
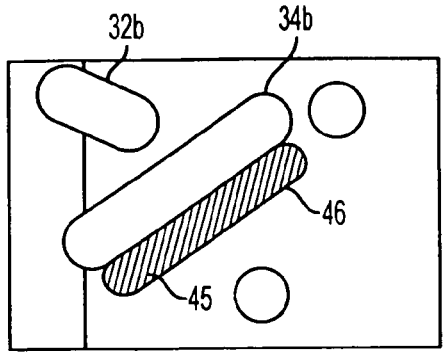
FIG. 5A is cross-sectional view of a side plate, showing the first embodiment of the restraining means.
Figure 5B:
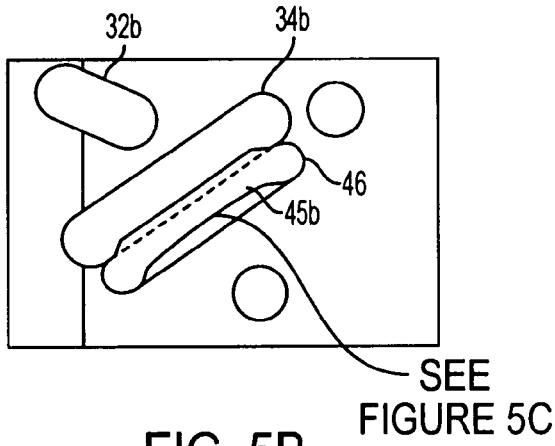
FIG. 5B is a cross-sectional view of a side plate, showing the second embodiment of the restraining means.
Figure 5C:
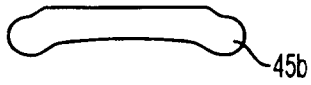
FIG. 5C is a view of the spring material used in the second embodiment of the restraining means.

FIGS. 1–7 depict one embodiment of the present invention, with FIGS. 5A and 5B showing two different types of pin restrainers that can be used.

Figure 1:
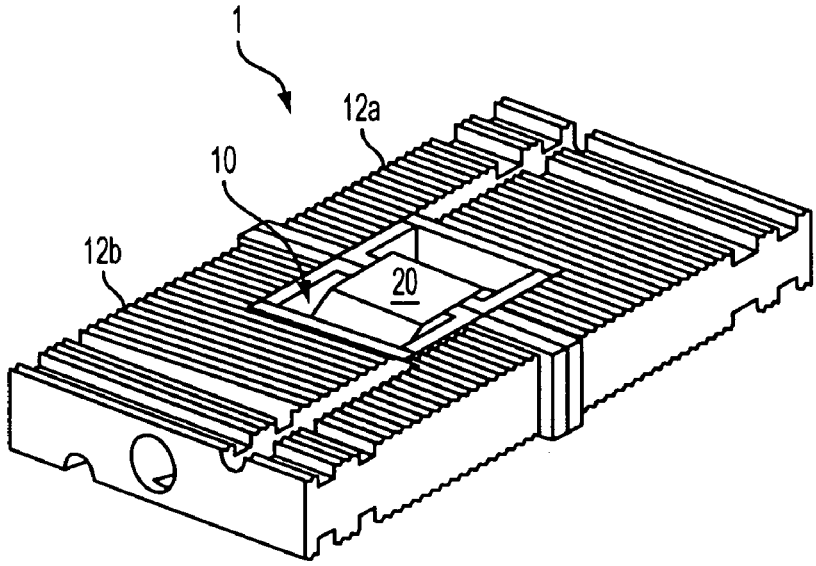
FIG. 1 is an isometric view of the assembled hinge, including mounting members.
Figure 2:
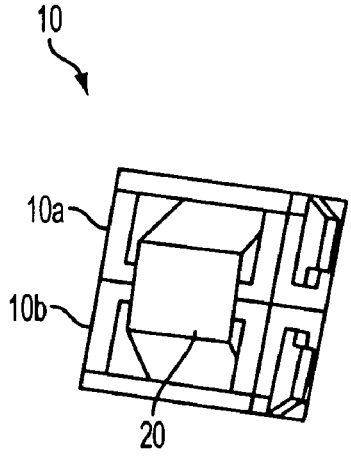
FIG. 2 is an isometric view of the hinge cage.

As shown in FIGS. 1 and 2, hinge cage 10 connects mounting members 12*a* and 12*b*. Hinge cage 10 comprises a center link 20 disposed between and pivotally connecting first and second cage portions 10*a* and 10*b* (the components of hinge cage 10 are shown in more detail in FIG. 4). The first and second cage portions 10*a* and 10*b* are mounted in first and second mounting members 12*a* and 12*b*, respectively. The mounting members 12*a* and 12*b* can be made of a variety of materials, but in the preferred embodiment are made from 6061 T6511 aluminum. Hinge assembly 1 allows the mounting members 12*a* and 12*b* to pivot 180 degrees relative to one another about two dynamic axes of rotation. By "dynamic" it is meant that the axes of rotation move slightly away from each other during the operation of the hinge.

Figure 4A:
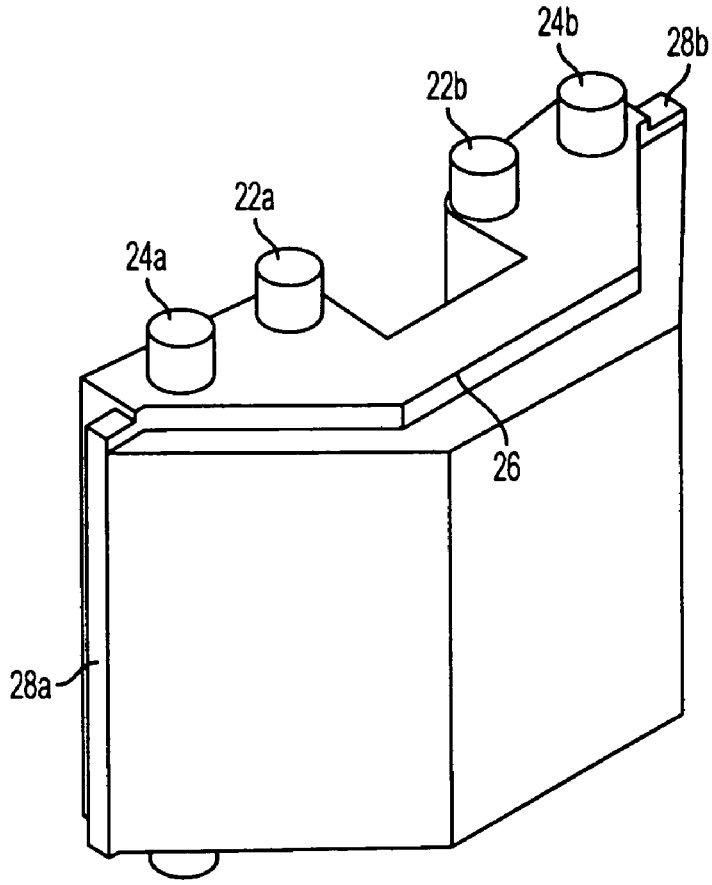
FIG. 4A is a close-up isometric view of the hinge link.

FIG. 3 is a cross-sectional view of the hinge assembly depicted in FIG. 1, FIG. 4 is an isometric view of the disassembled hinge, and FIG. 4A is a close-up isometric view of the center link 20. As shown in FIG. 4, hinge cage 10 comprises a pair of opposite side plates 16*a* and 18*a*, a pair of opposite side plates 16*b* and 18*b*, opposite end plates 14*a* and 14*b*, and a center link 20. As seen by comparing FIGS. 4 and 2, cage portion 10*a* includes two side plates 16*a* and 18*a*, and one end plate 14*a*; similarly, cage portion 10*b* includes two side plates 16*b* and 18*b*, and one end plate 14*b*.

In the preferred embodiment, hinge components 14*a*, 14*b*, 16*a*, 16*b*, 18*a*, 18*b*, and 20 are all made from 416 stainless steel which is heat treated to RC 42–45, yielding a tensile strength of 200,000 pounds. This material provides the hinge with great strength and reduces the chance of breakage if a heavy weight is placed on the extended leaf.

Protruding from the lateral faces of center link 20 are steering pins 22*a* and 22*b*, and hinge pins 24*a* and 24*b*, all of which extend in a direction parallel to the dynamic axes. (For ease of distinction, the pins that are closer together will arbitrarily be called "steering pins" and the outside pins will arbitrarily be called "hinge pins.") These pins can vary in size and material, and they can be integral with the center link or they can be the opposite ends of a cylinder that is slidably mounted in a through-hole in the link. As one example of the latter embodiment, each cylinder can be a 1"×3/32" stainless steel cylinder, having a tensile strength of 160,000 pounds.

The center link 20 further comprises first and second projections 28*a* and 28*b*, and stepped portion 26. Stepped portion 26 is formed by a notch in each lateral side of the link.

Each of the side plates 16*a*, 16*b*, 18*a* and 18*b* includes two non-parallel guide slots and one tab. For example, side plate 16*a* includes guide slots 32*a* and 34*a* and tab 36*a*, and side plate 16*b* includes guide slots 32*b* and 34*b* and tab 36*b*. Each of the side plates further includes a tongue 42. Finally, each end plate 14*a* and 14*b* includes two notches 44 and one stop slot (38*a* and 38*b*, respectively).

The relationship among the parts can be seen in FIG. 4. The steering pins 22*a* and 22*b* fit into short guide slots 32*a* and 32*b*, respectively. The hinge pins 24*a* and 24*b* fit into long guide slots 34*a* and 34*b*, respectively. The tongues 42 of the side plates (16*a*, 16*b*, 18*a* and 18*b*) mate with the notches 44 in the end plates 14*a* and 14*b*, and engage grooves 43 formed in the mounting members 12*a* and 12*b*. Thus, hinge cage portions 10*a* and 10*b* are positioned in the respective mounting members 12*a* and 12*b*. The hinge cages are secured in their respective mounting members by screws (not shown). The mounting screws can be made of a variety of materials, but might be, for example, 6/32 stainless steel panhead screws.

In mounting members 12*a* and 12*b* preferably include features to facilitate assembly, disassembly, and attachment to an object. As shown in FIGS. 1 and 4, the mounting members 12*a* and 12*b* have a through-bore 48 extending the axial length of the mounting member for attachment of the mounting members to an object, such as a table leaf. During installation, the mounting member is inserted in the object prior to assembly of the hinge. An adhesive is then applied in the through-bore 48 to secure the mounting member in place. It is anticipated that, instead of an adhesive, a screw or other fastener could be used to attach the mounting member to the object. In addition, each mounting member preferably has one or more grooves 52 formed in the exterior of the mounting member. These grooves 52 facilitate disassembly of the hinge by allowing a punch or other tool to be inserted to separate the end plate 14*b* from the mounting member 12*b*.

As noted above, short guide slots 32*a* and 32*b* are non-parallel with respect to long guide slots 34*a* and 34*b*. In each pair (e.g., 32*a* and 34*a*), the slots are angled toward each other, growing closer together in the direction running from the link toward the adjacent end plate. For each side plate 16*a*, 16*b*, 18*a*, and 18*b*, if a center line of the short slot 32*a* and 32*b* were extended far enough beyond the slot ends, that center line would intersect the long slot at a location intermediate its ends. The acute angle of intersection is preferably in the range of about 55 to 60 degrees. Preferably—as shown in the drawings—in each pair, the short guide slot (32*a* or 32*b*) is located closer to center link 20, while the long guide slot (34*a* or 34*b*) is located closer to its adjacent end plate (14*a* or 14*b*). As a result, when one pin on a side plate is forced to slide in one direction, the other pin on the same side plate is forced to slide in a different direction. For example, when mounting member 12*a* is turned relative to center link 20, steering pin 22*a* is forced to slide in guide slot 32*a*, while guide pin 24*a* is forced to slide in a different direction (i.e., along a nonparallel vector) in guide slot 34*a*. This motion causes cage portion 10*a* to both turn and translate with respect to center link 20. Consequently, mounting member 12*a* not only rotates relative to center link 20, but also moves slightly away from the other mounting member 12*b*. This simultaneous translation and pivoting movement reduces the need for a clearance gap between objects attached to mounting members, such as between the table top T and leaf L depicted in FIG. 6.

Figure 7A:
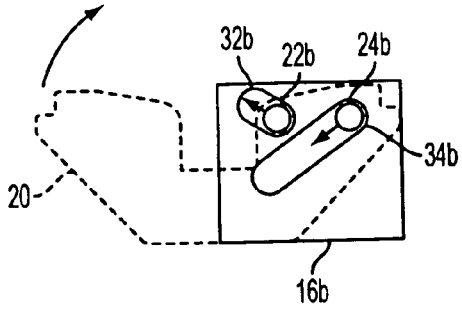
FIGS. 7A–7D depict the center link and one of the side plates at four positions during folding.
Figure 7B:
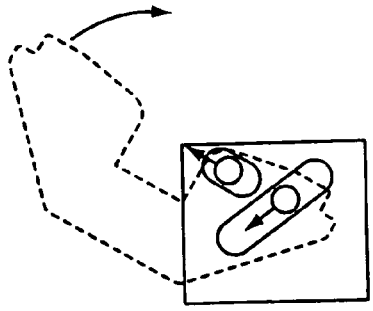
Figure 7C:
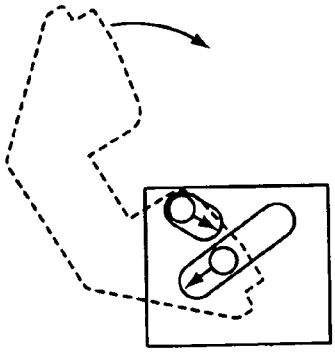
Figure 7D:
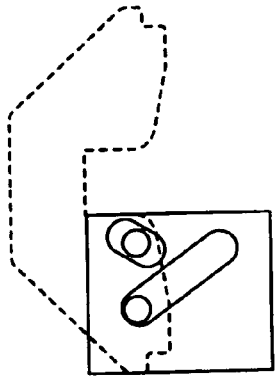

FIGS. 7A–7D illustrate the motion of center link 20 relative to side plate 16*b*, as pins 22*b* and 24*b* move in guide slots 32*b* and 34*b*. In FIG. 7A, the hinge is in its fully extended position, while in FIG. 7D the hinge is fully folded. FIGS. 7B and 7C depict intermediate positions during the folding of the hinge. As FIGS. 7A–7D illustrate, pins 22*b* and 24*b* move in different directions (i.e., along nonparallel vectors) during motion of the hinge. FIG. 7A depicts the hinge in its close-together position, in which the vertical center line (VCL) of link 20 lies in the same plane as the left edge of side plate 16*b*. As shown in FIG. 7B, the initial clockwise turning of link 20 causes a separation between the VCL and the left edge of plate 16*b*. Thus, even if the opposed-edge faces of the two objects that are hinged together (not shown) were touching—i.e., were in abutment—when at the FIG. 7A position, those faces would not interfere with each other during the folding-up of link 20. Rather, they would immediately separate, as shown in FIG. 7B, and would remain separated throughout the 90 degrees of swing, as shown in FIGS. 7C and 7D. And this can be so even though the pivoting axis is located below the top surfaces of the objects that the hinge joins together.

Figure 6:
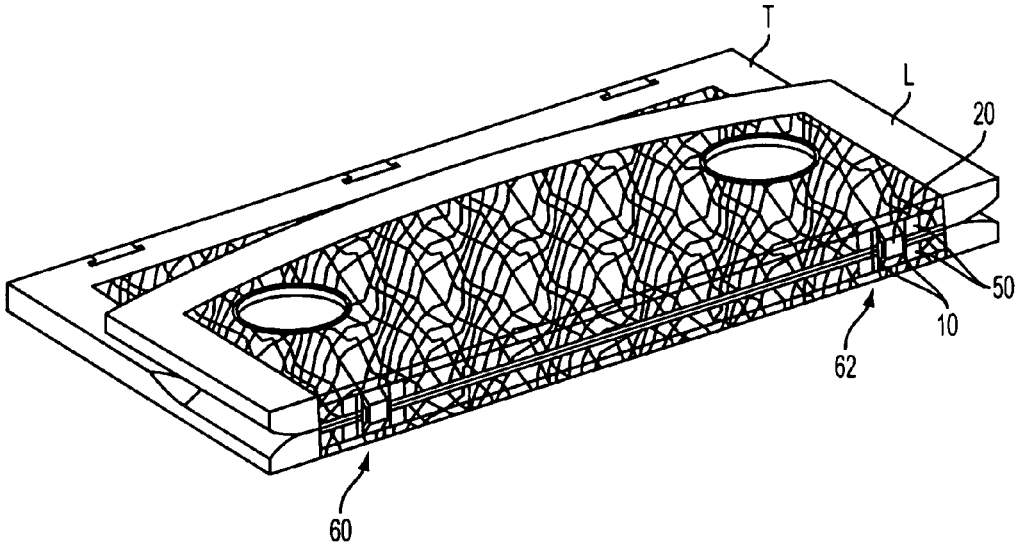
FIG. 6 is an isometric view of the tabletop and leaf joined together by a pair of hinges.

FIG. 6 shows a pair of hinges according to a preferred embodiment of my invention, mounted in a table-top and leaf combination. The table leaf L is shown in the stored position. Table-top T and leaf L are connected by a pair of hinges 60 and 62. As can be seen in FIG. 6, the leaf L folds over fully and lays flat on the table top, thus occupying minimum storage space when in this stored position. In this embodiment, screw covers 50 cover the heads of the mounting screws (not shown), thus enhancing the aesthetic appearance of the hinge. Screw covers can be made from a variety of materials, such as, for example, 6061T6511 aluminum, and can be attached by any suitable method, such as fasteners, adhesive, and the like.

I have found that when using a fold-over/drop-leaf table of the type depicted in FIG. 6, it is preferable to include one or more restrainers, to ensure sequential folding of the hinge and thereby prevent binding. Binding can occur in applications where two or more hinges without restrainers are used in parallel, and the hinges do not rotate in synchronisation. For example, in the fold-over/drop-leaf table of FIG. 6, if restrainers were not used, binding might occur when the leaf L is folded from an extended position toward the table top T if hinge 60 starts to rotate at its table top side T, while hinge 62 starts to rotate from the leaf side L or vice versa. Using a restraint in each hinge forces the hinges to start their rotations from the same end every time, thereby eliminating the possibility of binding.

FIGS. 5A and 5B depict two possible restraining means for the swinging action between center link 20 and one pair of side plates (e.g., side plates 16*b* and 18*b*). A restrainer 45 is positioned in at least one, and preferably both, of the hinge slots 34*b* of cage portion 10*b* (the "restrained" cage portion). As shown in FIG. 5A, the restrainer 45 sits in a side pocket 46 which abuts and joins hinge slot 34*b*. The restrainer 45 prevents the second mounting member 12*b* from rotating relative to the center link 20 until the first mounting member 12*a* has finished rotating through its full range of motion. It is contemplated that one can use any type of pin restrainer that has a higher coefficient of friction than the material of which the opposite wall of the groove is made. For example, if the side plates are made of stainless steel, the restrainers can be made of an elastomeric material, such as Delrin® 500, Celcon® M90, or the like. Thus, the restrainer 45 frictionally engages the hinge pin 24*b*. Alternatively, as shown in FIG. 5B, the restrainer may comprise a piece of spring material 45*b*, which acts as a detent mechanism to partially restrain the second mounting member 12*b* from rotating and sliding. As a spring material 45*b*, one can use, for example, a cam made from Delring® sheet, spring steel, or the like.

FIG. 3 shows how the hinge's rotation is stopped in a manner that substantially eliminates shear stress from the pins when weight is placed on the table during use (i.e., when the leaf is in the extended position, as shown in FIG. 3). When hinge assembly 1 is in its fully extended position, the stop slots 38*a* and 38*b* of the end plates 14*a* and 14*b* engage projections 28*a* and 28*b* of the center link 20 at stop points A. Similarly, tabs 36*a* and 36*b* of the side plates (16*a*, 16*b*, 18*a* and 18*b*) engage the stepped portion 26 of the center link 20 at stop points B. As a result of this arrangement, the bulk of the weight supported by hinge assembly 1 is concentrated at the stop points A and B, rather than being supported by the steering pins 22*a* and 22*b*, or the hinge pins 24*a* and 24*b*. This arrangement gives the hinge a greater mechanical advantage and distributes the resulting stresses over a larger area than the pins, thereby, allowing the hinge to support greater loads.

While the invention has been explained by a detailed description of a specific embodiment of it, it is to be understood that various modifications and/or substitutions may be made without departing from the spirit of the invention. For example, some or all of the pins (22*a*, 22*b*, 24*a*, and/or 24*b*) may be disposed on the side plates (16*a*, 16*b*, 18*a*, and/or 18*b*) rather than on the center link 20, with the corresponding guide slots (32*a*, 32*b*, 34*a* and/or 34*b*) disposed on the center link 20 rather than on the side plates. In other words, the placement of some or all the pins and guide slots can be exchanged. Accordingly, the invention should not be deemed limited by the detailed description of the embodiments set out above, but only by the following claims.

I claim:

1. A hinge comprising:

(a) a link having a first end, a second end, two lateral sides, a first projection extending from the first end, a notch in each lateral side, and, near the first end of each lateral side of the link, one of:

(i) a pair of parallel pins protruding from each of the opposite sides, wherein the pins are spaced apart from each other by a fixed distance, and the pins protruding from one side are axially aligned with the pins protruding from the other side, and (ii) a pair of non-parallel guide slots; and (b) a first assembly comprising a pair of first side plates, a first end plate having a stop slot, and a tab protruding from each of the pair of first side plates, one first side plate positioned on each lateral side of the link near the first end of the link, and each first side plate having the other of (i) and (ii), such that each pin slidably engages one of the guide slots and the pair of pins can simultaneously slide in their respective guide slots, while remaining the fixed distance apart from each other, wherein, since the guide slots of each pair of guide slots are non-parallel, when one pin is forced to slide in one direction, the other pin of the pair is forced to slide in a different direction, thereby causing the first assembly to both turn and translate with respect to the link, whereby the first assembly is pivotable relative to the link between a first position and a second position, the link and first assembly being further apart in the second position than in the first position, and wherein the first assembly is pivotable, relative to the link, between an extended position and a folded position, with further pivoting of the first assembly beyond the extended position being limited both by abutment of the first projection of the link against the stop slot of the first end plate and by abutment of the notch in each lateral side of the link against the tab of each of the first side plates.

2. A hinge according to claim 1, wherein the link further comprises, near the second end of each lateral side of the link, one of:

(iii) a pair of parallel pins protruding from each of the opposite sides, the pins being spaced apart from each other by a fixed distance, and the pins protruding from one side being axially aligned with the pins protruding from the other side, and (iv) a pair of non-parallel guide slots, and wherein the hinge further comprises:

(c) a second assembly comprising a pair of second side plates, one second side plate positioned on each lateral side of the link near the second end of the link, and each second side plate having the other of (iii) and (iv), such that each pin slidably engages one of the guide slots and the pair of pins can simultaneously slide in their respective guide slots, while remaining the fixed distance apart from each other, wherein, since the guide slots of each pair of guide slots are non-parallel, when one pin is forced to slide in one direction, the other pin of the pair is forced to slide in a different direction, thereby causing the second assembly to also both turn and translate with respect to the link, whereby the second assembly is pivotable relative to the link between a first position and a second position, the link and second assembly being further apart in the second position than in the first position.

3. A hinge according to claim 2, wherein said link further comprises a second projection extending from the second end of the link, and said second assembly further comprises a second end plate having a stop slot, and a tab protruding from each member of the pair of second side plates, and wherein the second assembly is pivotable, relative to the link, between an extended position and a folded position, with further pivoting of the second assembly beyond the extended position being limited both by abutment of the second projection of the link against the stop slot of the second end plate and by abutment of the notch in each lateral side of the link against the tab of each of the second side plates.

4. A hinge according to claim 3, wherein the first assembly further comprises a first mounting member, to which the first side plates and first end plate are attached, and the second assembly further comprises a second mounting member, to which the second side plates and second end plate are attached, the first mounting member being configured to be attached to a first object and the second mounting member being configured to be attached to a second object, so as to hingedly connect said first and second objects.

5. A hinge according to claim 2, wherein each of the first and second assemblies is pivotable about 90 degrees, relative to the link, such that the first assembly is pivotable about 180 degrees relative to the second assembly.

6. A hinge according to claim 1, wherein the first assembly is pivotable at least about 90 degrees, relative to the link, and at least those portions of the slots that guide the pins through the first 90 degrees of swing from the close-together position are substantially straight.

7. A hinge according to claim 6, wherein the link further comprises, near the second end of each lateral side of the link, one of:

(iii) a pair of parallel pins protruding from each of the opposite sides, the pins being spaced apart from each other by a fixed distance, and the pins protruding from one side being axially aligned with the pins protruding from the other side, and (iv) a pair of non-parallel guide slots;

and wherein the hinge further comprises:

(c) a second assembly comprising a pair of second side plates, one second side plate positioned on each lateral side of the link near the second end of the link, and each second side plate having the other of (iii) and (iv), such that each pin slidably engages one of the guide slots and the pair of pins can simultaneously slide in their respective guide slots, while remaining the fixed distance apart from each other, wherein, since the guide slots of each pair of guide slots are non-parallel, when one pin is forced to slide in one direction, the other pin of the pair is forced to slide in a different direction, thereby causing the second assembly to also both turn and translate with respect to the link, whereby the second assembly is pivotable relative to the link between a first position and a second position, the link and second assembly being further apart in the second position than in the first position.

8. The hinge of claim 7, wherein the second assembly is pivotable at least about 90 degrees, relative to the link, and at least those portions of the slots that guide the second-assembly pins through the first 90 degrees of swing from the second-assembly-close-together position also are substantially straight.

9. A hinge according to claim 8, further comprising:

(d) a restrainer disposed in at least one of the guide slots associated with the second end of the link, the pin in each restrainer-containing guide slot being restrained from sliding in the guide slot until at least a predetermined threshold force is applied to the pin, wherein the first and second assemblies are each pivotable relative to the link between an extended position and a folded position, and wherein since the second assembly is restrained, the first assembly swings fully between the extended and folded positions before the second assembly begins to swing relative to the link, thereby causing the first and second assemblies to swing sequentially.

10. A hinge according to claim 9, wherein said link further comprises a first projection extending from the first end of the link, and a notch in each lateral side of the link, and said first assembly further comprises a first end plate having a stop slot, and a tab protruding from each of the pair of first side plates, and wherein the first assembly is pivotable, relative to the link, between an extended position and a folded position, with further pivoting of the first assembly beyond the extended position being limited both by abutment of the first projection of the link against the stop slot of the first end plate and by abutment of the notch in each lateral side of the link against the tab of each of the first side plates.

11. A hinge according to claim 10, wherein said link further comprises a second projection extending from the second end of the link, and said second assembly further comprises a second end plate having a stop slot, and a tab protruding from each member of the pair of second side plates, and wherein the second assembly is pivotable, relative to the link, between an extended position and a folded position, with further pivoting of the second assembly beyond the extended position being limited both by abutment of the second projection of the link against the stop slot of the second end plate and by abutment of the notch in each lateral side of the link against the tab of each of the second side plates.

12. A hinge according to claim 11, wherein the first assembly further comprises a first mounting member, to which the first side plates and first end plate are attached, and the second assembly further comprises a second mounting member, to which the second side plates and second end plate are attached, the first mounting member being configured to be attached to a first object and the second mounting member being configured to be attached to a second object, so as to hingedly connect said first and second objects.

13. A hinge according to claim 12, wherein each of the first and second assemblies is pivotable about 90 degrees, relative to the link, such that the first assembly is pivotable about 180 degrees relative to the second assembly.

14. A hinge according to claim 13, wherein each pair of non-parallel guide slots comprises a first substantially straight slot, having a centerline, and a second substantially straight slot, also having a centerline, the second substantially straight slot being longer than the first, which slots do not intersect, but are angled toward each other in a direction running from the link toward the adjacent assembly, and wherein the centerline of the first slot, if extended far enough beyond the end of the first slot, would cross the second slot at a location intermediate the ends of the second slot.

15. A hinge according to claim 14, wherein the acute angle of intersection between the extended centerline of the first slot and the centerline of the second slot is between about 55 and about 60 degrees.

16. The combination of a table having a top with an edge, and a fold-up leaf having an edge, and at least two hinges mounting said leaf to the edge of said table-top, each said hinge comprising:

(a) a link having a first end, a second end, two lateral sides, a first projection extending from the first end, a notch in each lateral side, and, near the first end of each lateral side of the link, one of:

(i) a pair of parallel pins protruding from each of opposite sides of the link, wherein the pins are spaced apart from each other by a fixed distance, and the pins protruding from one side are axially aligned with the pins protruding from the other side, and (ii) a pair of non-parallel guide slots;

and wherein the link further comprises, near the second end of each lateral side of the link, one of:

(iii) a pair of parallel pins protruding from each of the opposite sides, the pins being spaced apart from each other by a fixed distance, and the pins protruding from one side being axially aligned with the pins protruding from the other side, and (iv) a pair of non-parallel guide slots;

(b) a first assembly comprising a pair of first side plates, a first end plate having a stop slot, and a tab protruding from each of the pair of first side plates, one first side plate positioned on each lateral side of the link near the first end of the link, and each first side plate having the other of (i) and (ii), such that each pin slidably engages one of the guide slots and the pair of pins can simultaneously slide in their respective guide slots, while remaining the fixed distance apart from each other; and (c) a second assembly comprising a pair of second side plates, one second side plate positioned on each lateral side of the link near the second end of the link, and each second side plate having the other of (iii) and (iv), such that each pin slidably engages one of the guide slots and the pair of pins can simultaneously slide in their respective guide slots, while remaining the fixed distance apart from each other, wherein, since the guide slots of each pair of guide slots are non-parallel, when one pin is forced to slide in one direction, the other pin of the pair is forced to slide in a different direction, thereby causing each said assembly to both turn and translate with respect to the link, whereby each of the first and second assemblies is pivotable relative to the link between a first position and a second position, each assembly being further from the link in the second position than in the first position, and wherein the first assembly is pivotable, relative to the link, between an extended position and a folded position, with further pivoting of the first assembly beyond the extended position being limited both by abutment of the first projection of the link against the stop slot of the first end plate and by abutment of the notch in each lateral side of the link against the tab of each of the first side plates.

17. A combination according to claim 16, wherein said link further comprises a second projection extending from the second end of the link, and said second assembly further comprises a second end plate having a stop slot, and a tab protruding from each member of the pair of second side plates, and wherein the second assembly is pivotable, relative to the link, between an extended position and a folded position, with further pivoting of the second assembly beyond the extended position being limited both by abutment of the second projection of the link against the stop slot of the second end plate and by abutment of the notch in each lateral side of the link against the tab of each of the second side plates.

18. A combination according to claim 17, wherein the first assembly further comprises a first mounting member, to which the first side plates and first end plate are attached, and the second assembly further comprises a second mounting member, to which the second side plates and second end plate are attached, the first mounting member being configured to be attached to a first object and the second mounting member being configured to be attached to a second object, so as to hingedly connect said first and second objects.

19. A combination according to claim 16, wherein each of the first and second assemblies is pivotable about 90 degrees, relative to the link, such that the first assembly is pivotable about 180 degrees relative to the second assembly.

20. A hinge according to claim 19, wherein each pair of non-parallel guide slots comprises a first substantially straight slot, having a centerline, and a second substantially straight slot, also having a centerline, the second substantially straight slot being longer than the first, which slots do not intersect, but are angled toward each other in a direction running from the link toward the adjacent assembly, and wherein the centerline of the first slot, if extended far enough beyond the end of the first slot, would cross the second slot at a location intermediate the ends of the second slot.

21. A hinge according to claim 20, wherein the acute angle of intersection between the extended centerline of the first slot and the centerline of the second slot is between about 55 and about 60 degrees.

22. A hinge comprising:

(a) a link having a first end, a second end, two lateral sides, and, near the first end of each lateral side of the link, one of:

(i) a pair of parallel pins protruding from each of the opposite sides, wherein the pins are spaced apart from each other by a fixed distance, and the pins protruding from one side are axially aligned with the pins protruding from the other side, and (ii) a pair of non-parallel guide slots, and wherein the link further comprises, near the second end of each lateral side of the link, one of:

(iii) a pair of parallel pins protruding from each of the opposite sides, the pins being spaced apart from each other by a fixed distance, and the pins protruding from one side being axially aligned with the pins protruding from the other side, and (iv) a pair of non-parallel guide slots;

(b) a first assembly comprising a pair of first side plates, one first side plate positioned on each lateral side of the link near the first end of the link, and each first side plate having the other of (i) and (ii), such that each pin slidably engages one of the guide slots and the pair of pins can simultaneously slide in their respective guide slots, while remaining the fixed distance apart from each other;

(c) a second assembly comprising a pair of second side plates, one second side plate positioned on each lateral side of the link near the second end of the link, and each second side plate having the other of (iii) and (iv), such that each pin slidably engages one of the guide slots and the pair of pins can simultaneously slide in their respective guide slots, while remaining the fixed distance apart from each other, wherein, since the guide slots of each pair of guide slots are non-parallel, when one pin is forced to slide in one direction, the other pin of the pair is forced to slide in a different direction, thereby causing each assembly to both turn and translate with respect to the link, whereby each of the first and second assemblies is pivotable relative to the link between a first position and a second position, each assembly being further apart from the link in the second position than in the first position; and (d) a restrainer disposed in at least one of the guide slots associated with the second end of the link, the pin in each restrainer-containing guide slot being restrained from sliding in the guide slot until at least a predetermined threshold force is applied to the pin, wherein the first and second assemblies are each pivotable relative to the link between an extended position and a folded position, and wherein since the second assembly is restrained, the first assembly swings fully between the extended and folded positions before the second assembly begins to swing relative to the link, thereby causing the first and second assemblies to swing sequentially.

23. A hinge according to claim 22, wherein each restrainer comprises an elongated piece of elastomeric material extending at least part of the length of the respective guide slot.

24. A hinge according to claim 22, wherein each restrainer comprises a leaf spring having two ends and a convex central portion, the two ends of the spring being positioned against a side of the respective guide slot with the convex central portion protruding into the center of the respective guide slot.

25. The combination of a table having a top with an edge, and a fold-up leaf having an edge, and at least two hinges mounting said leaf to the edge of said table-top, each said hinge comprising:

(a) a link having a first end, a second end, two lateral sides, and, near the first end of each lateral side of the link, one of:

(i) a pair of parallel pins protruding from each of opposite sides of the link, wherein the pins are spaced apart from each other by a fixed distance, and the pins protruding from one side are axially aligned with the pins protruding from the other side, and (ii) a pair of non-parallel guide slots;

and wherein the link further comprises, near the second end of each lateral side of the link, one of:

(iii) a pair of parallel pins protruding from each of the opposite sides, the pins being spaced apart from each other by a fixed distance, and the pins protruding from one side being axially aligned with the pins protruding from the other side, and (iv) a pair of non-parallel guide slots;

(b) a first assembly comprising a pair of first side plates, one first side plate positioned on each lateral side of the link near the first end of the link, and each first side plate having the other of (i) and (ii), such that each pin slidably engages one of the guide slots and the pair of pins can simultaneously slide in their respective guide slots, while remaining the fixed distance apart from each other;

(c) a second assembly comprising a pair of second side plates, one second side plate positioned on each lateral side of the link near the second end of the link, and each second side plate having the other of (iii) and (iv), such that each pin slidably engages one of the guide slots and the pair of pins can simultaneously slide in their respective guide slots, while remaining the fixed distance apart from each other, wherein, since the guide slots of each pair of guide slots are non-parallel, when one pin is forced to slide in one direction, the other pin of the pair is forced to slide in a different direction, thereby causing each said assembly to both turn and translate with respect to the link, whereby each of the first and second assemblies is pivotable relative to the link between a first position and a second position, each assembly being further from the link in the second position than in the first position; and (d) a restrainer disposed in at least one of the guide slots associated with the second end of the link, the pin in each restrainer-containing guide slot being restrained from sliding in the guide slot until at least a predetermined threshold force is applied to the pin, wherein the first and second assemblies are each pivotable relative to the link between an extended position and a folded position, and wherein since the second assembly is restrained, the first assembly swings fully between the extended and folded positions before the second assembly begins to swing relative to the link, thereby causing the first and second assemblies to swing sequentially.

26. A combination according to claim 25, wherein each restrainer comprises an elongated piece of elastomeric material extending at least part of the length of the respective guide slot.

27. A combination according to claim 25, wherein each restrainer comprises a leaf spring having two ends and a convex central portion, the two ends of the spring being positioned against a side of the respective guide slot with the convex central portion protruding into the center of the respective guide slot.

* * * * *